US010718517B2

(12) United States Patent
Huang et al.

(10) Patent No.: US 10,718,517 B2
(45) **Date of Patent: *Jul. 21, 2020**

(54) GAS APPLIANCE AND CONTROL METHOD THEREOF

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 149 days.

This patent is subject to a terminal disclaimer.

(21) Appl. No.: 15/970,097

(22) Filed: May 3, 2018

(65) Prior Publication Data

US 2019/0338951 A1 Nov. 7, 2019

(51) Int. Cl.
*F23N 5/10* (2006.01)
*F23Q 3/00* (2006.01)
*F23Q 9/14* (2006.01)

(52) U.S. Cl.
CPC ..... *F23N 5/105* (2013.01); *F23Q 3/00* (2013.01); *F23Q 9/14* (2013.01); *F23N 2227/36* (2020.01); *F23N 2235/14* (2020.01); *F23N 2239/04* (2020.01)

(58) Field of Classification Search
CPC . F24C 3/12; F23N 1/005; F23N 5/105; F23N 5/12; F23Q 3/00
USPC ..... 126/38 BA
See application file for complete search history.

(56) References Cited

U.S. PATENT DOCUMENTS

| | | | | |
|---|---|---|---|---|
| 6,410,842 | B1 * | 6/2002 | McAlonan | H01L 35/00 136/242 |
| 7,806,683 | B2 * | 10/2010 | Mitxelena | F23K 5/16 431/80 |
| 9,951,951 | B2 * | 4/2018 | Lovascio | F23N 1/002 |
| 2006/0234176 | A1 * | 10/2006 | Willms | F23N 5/102 431/80 |
| 2007/0284000 | A1 * | 12/2007 | Lee | F23N 5/102 137/66 |
| 2009/0004612 | A1 * | 1/2009 | West | F23N 1/002 431/22 |

(Continued)

*Primary Examiner* — Edelmira Bosques
*Assistant Examiner* — Nikhil P Mashruwala
(74) *Attorney, Agent, or Firm* — R. Lynette Wylie; Apex Juris, pllc.

(57) ABSTRACT

A gas appliance includes a burner, a gas valve, an ignitor, a thermocouple, and a control device, wherein the control device is adapted to execute a control method comprising the following steps: controlling the ignitor to ignite and the gas valve to open; receiving a sensing voltage output from the thermocouple; stop the ignitor from igniting and controlling the gas valve to keep a gas pipe be in an open state when the sensing voltage increases to a first voltage; receiving the sensing voltage output from the thermocouple continuously, and controlling the gas valve to block the gas pipe when the sensing voltage decreases from higher than a second voltage to lower than the second voltage, wherein the second voltage is higher than the first voltage. Whereby, an ignition procedure could be speeded up and the gas could be blocked earlier as the flames are extinguished.

11 Claims, 5 Drawing Sheets

(56) References Cited

U.S. PATENT DOCUMENTS

| | | | | |
|---|---|---|---|---|
| 2010/0236538 | A1* | 9/2010 | Wah | F23N 5/105<br>126/39 BA |
| 2011/0033808 | A1* | 2/2011 | Geiger | F23N 1/022<br>431/12 |
| 2013/0240767 | A1* | 9/2013 | Naumann | F23K 5/007<br>251/213 |
| 2016/0084506 | A1* | 3/2016 | Rickert | F24C 3/126<br>126/42 |
| 2019/0203936 | A1* | 7/2019 | Hazzard | F23N 1/022 |
| 2019/0271466 | A1* | 9/2019 | Businaro | F23N 5/102 |
| 2019/0338956 | A1* | 11/2019 | Huang | F23N 5/105 |
| 2020/0103105 | A1* | 4/2020 | Cadima | F23D 14/32 |

* cited by examiner

GAS APPLIANCE AND CONTROL METHOD THEREOF

BACKGROUND OF THE INVENTION

Technical Field

The present invention is related to a gas appliance, and more particularly to a gas appliance which could sense flames by utilizing a thermocouple.

Description of Related Art

Gas appliances are usually utilized as heating devices. As comparing to electro-thermal heating devices, the gas appliances provide more heat energy by burning gas. In addition, the gas appliances also have a heating time and a response time which are faster than the electro-thermal heating devices.

Referring to FIG. 1, a conventional gas appliance 1, which is a gas stove as an example, includes a burner 10, a manual gas regulating valve assembly 12, an ignitor 14, an ignition circuit 16, and a thermocouple 18. Wherein, the burner 10 is adapted to burn gas to generate flames. The manual gas regulating valve assembly 12 includes a valve body 122, a knob 124, and a switch 126, wherein the valve body 122 is disposed on a gas pipe p communicating with the burner 10, and an electromagnetic valve is disposed inside of the valve body 122 (not shown) for opening or blocking the gas pipe p; the knob 124 is engaged with the valve body 122, and is adapted to be operated by a user to open the electromagnetic valve; when the knob 124 is rotated, a gas flow rate supplying to the burner 10 could be regulated. In addition, when the knob 124 is rotated to an ignition position, the switch 126 would be triggered. The ignitor 14 is disposed adjacent to a flame port of the burner 10, and is electronically connected to the ignition circuit 16. When the switch 126 is triggered, the ignition circuit 16 would be triggered and controllable to supply high voltage to the ignitor 14 to generate sparks with respect to the burner 10 for igniting the gas output from the burner 10. The thermocouple 18 is disposed adjacent to the burner 10, and is adapted to sense the flames and output a corresponding sensing voltage; the thermocouple 18 is electronically connected to the electromagnetic valve of the valve body 122 to output the sensing voltage to the electromagnetic valve of the valve body 122.

When the user operates the conventional gas appliance 1, the user would press the knob 124 to open the electromagnetic valve of the valve body 122 for supplying the gas to the burner 10, and rotate the knob 124 to the ignition position to trigger the switch 126 and the ignitor 14 for igniting. Referring to FIG. 2, after igniting the gas, the sensing voltage output from the thermocouple 18 would increase gradually. When the sensing voltage increases to a predetermined voltage V, the electromagnetic valve would have a constant magnetic field and remain in an open state for the gas to pass through even the user releases the knob 124. Whereby, an ignition procedure is completed.

During the ignition procedure, in the beginning, although the user could see the generated flames, it is required for the thermocouple 18 to be heated for a longer time to output the sensing voltage which could reach the predetermined voltage V. Then, the user could release the knob 124. When the user releases the knob 124 too early, the electromagnetic valve would not have the constant magnetic field yet, and the gas pipe p would be blocked instantly. However, the user could not identify whether the electromagnetic valve has the constant magnetic field or not, and could only identify rely on his experience, resulting in inconvenience.

Referring to FIG. 2 again, moreover, after the successful ignition, when the flames are extinguished by wind, the sensing voltage output from the thermocouple 18 would decrease gradually. When the sensing voltage becomes lower than the predetermined voltage V, the electromagnetic valve would not remain magnetic anymore and the gas pipe p would be blocked instantly, whereby to prevent the gas from leaking out of the burner 10 continuously.

However, the sensing voltage output from the thermocouple 18 decreases with a speed much slower than its increasing speed while the thermocouple 18 is heated. Hence, when the flames are extinguished by wind, the sensing voltage requires a longer time (i.e., more than one minute) to become lower than the predetermined voltage V. In other words, when the flames are extinguished by wind, it requires more than one minute for the electromagnetic valve to block the gas pipe p.

In this way, when the flames are extinguished with a large gas flow rate, a large amount of gas would leak out of the burner 10 for more than one minute, thereby affecting the security of the conventional gas appliance 1, which could be even worse when there is additional spark to ignite the leaking gas.

BRIEF SUMMARY OF THE INVENTION

In view of the above, an object of the present invention is to provide a gas appliance and a control method thereof which could identify a successful ignition faster.

Another object of the present invention is to provide a gas appliance and a control method thereof which could block the gas earlier when the flames are extinguished, thereby improving the security of utilization.

To achieve the object mentioned above, the present invention provides a control method for a gas appliance, wherein the gas appliance includes a burner, a gas valve, an ignitor, and a thermocouple. The burner includes at least one flame port; the gas valve is disposed on a gas pipe communicating with the burner, and is controllable to open or block the gas pipe; the ignitor is disposed adjacent to the flame port of the burner, and is controllable to ignite gas output from the flame port; the thermocouple is disposed adjacent to the burner, and is adapted to sense flames and output a corresponding sensing voltage; the control method comprises steps of: A. controlling the ignitor to ignite, and controlling the gas valve to open the gas pipe; B. receiving the sensing voltage output from the thermocouple; C. stopping the ignitor from igniting and controlling the gas valve to keep the gas pipe be in an open state when the sensing voltage increases to a first voltage; D. receiving the sensing voltage output from the thermocouple continuously, and controlling the gas valve to block the gas pipe when the sensing voltage decreases from higher than a second voltage to lower than the second voltage, wherein the second voltage is higher than the first voltage.

The present invention provides a gas appliance including a burner, a gas valve, an ignitor, a thermocouple, and a control device. Wherein, the burner includes at least one flame port; the gas valve is disposed on a gas pipe communicating with the burner, and is controllable to open or block the gas pipe; the ignitor is disposed adjacent to the flame port of the burner, and is controllable to ignite gas output from the flame port; the thermocouple is disposed adjacent to the burner, and is adapted to sense flames and output a corresponding sensing voltage; the control device is electronically connected to the gas valve, the ignitor, and the thermocouple, wherein the control device is adapted to control the ignitor to ignite and control the gas valve to open the gas pipe, and to stop the ignitor from igniting and control the gas valve to keep the gas pipe be in an open state when the sensing voltage output from the thermocouple increases to a first voltage; then, the control device is adapted to control the gas valve to block the gas pipe when the sensing voltage output from the thermocouple decreases from higher than a second voltage to lower than the second voltage, wherein the second voltage is higher than the first voltage.

The advantage of the present invention is that through defining the sensing voltage output from the thermocouple as the first voltage for identifying the successful ignition, the ignition procedure with the ignitor could be speeded up, and the ignition time and the power consumption during the ignition could be reduced. The gas could further be blocked earlier as the second voltage, which is higher than the first voltage, is utilized for identifying the extinguished flames, thereby improving the security of the gas appliance.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
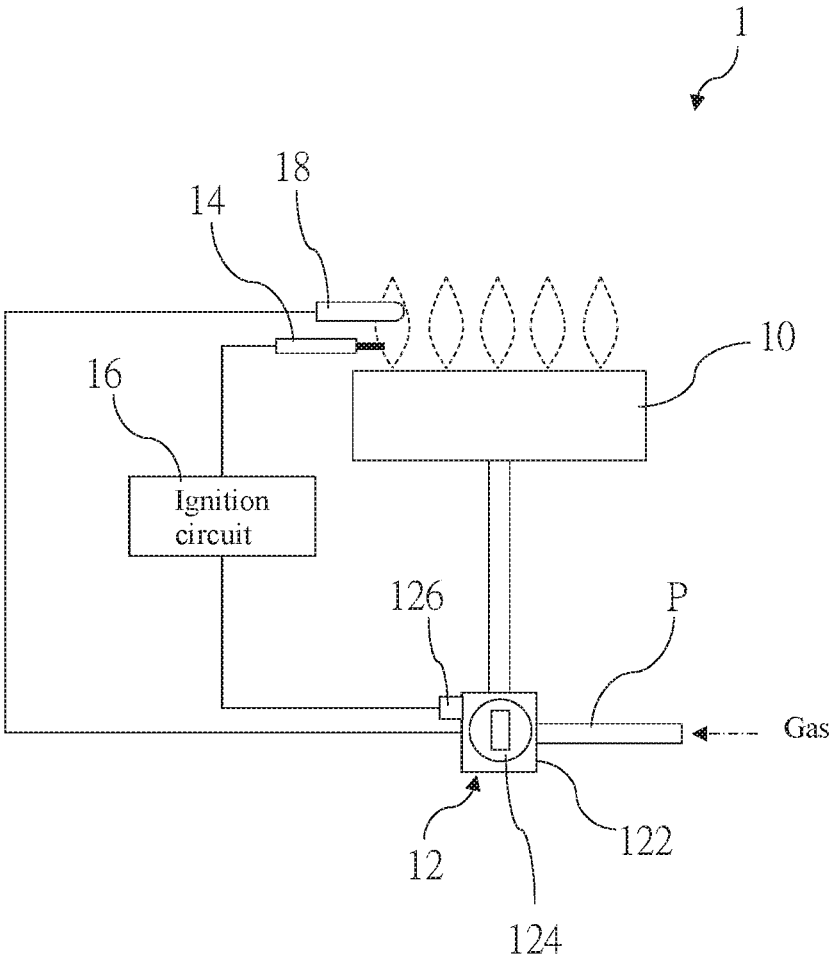
FIG. 1 (PRIOR ART)
FIG. 1 is a schematic view showing a conventional gas appliance.
Figure 2:
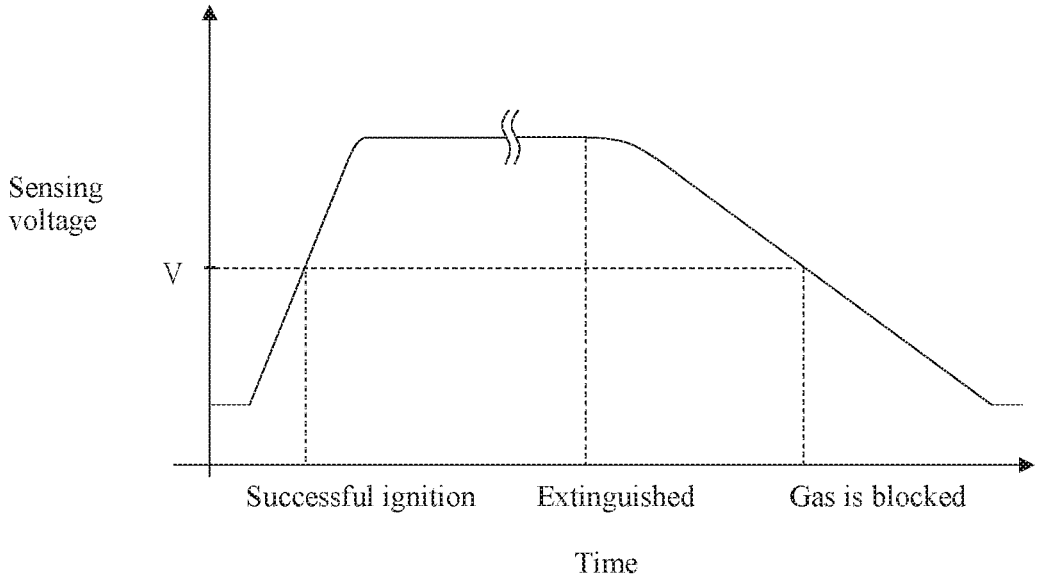
FIG. 2 (PRIOR ART)
FIG. 2 is a timing diagram showing a relationship between the sensing voltage output from the thermocouple of the conventional gas appliance and the time.
Figure 3:
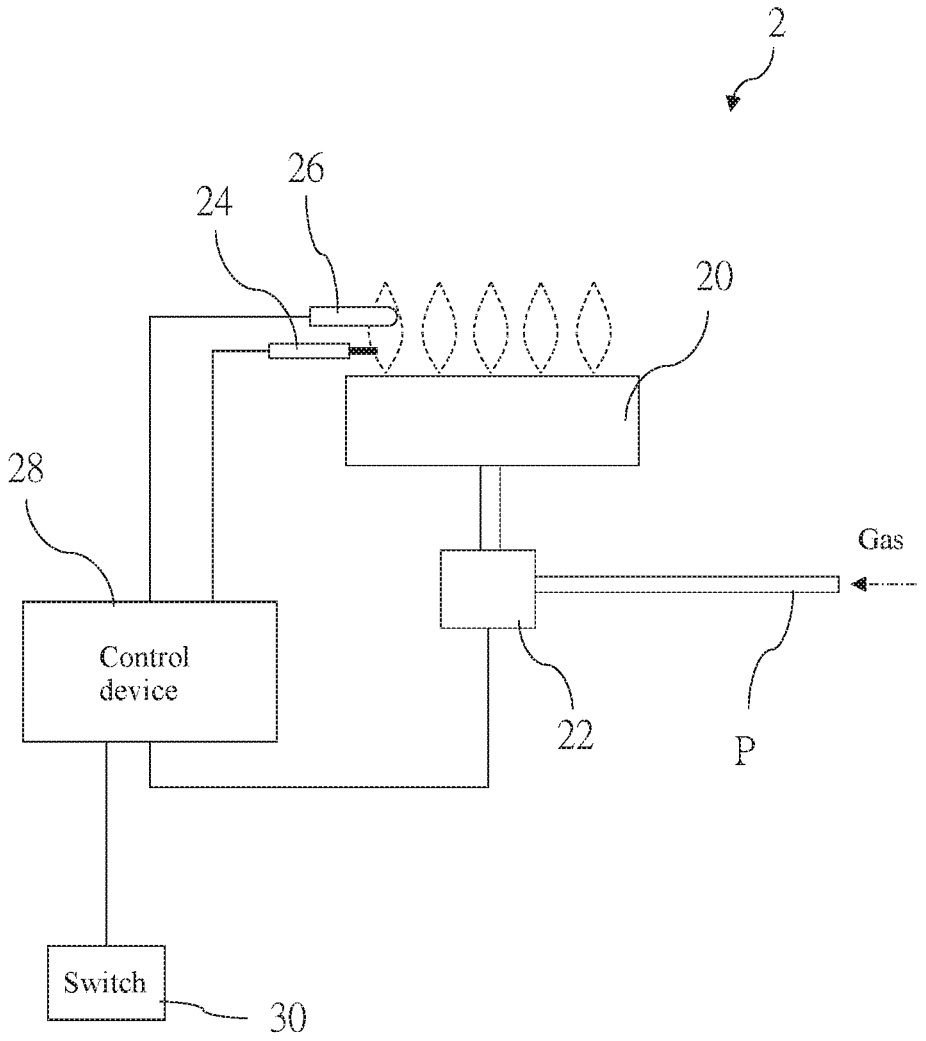
FIG. 3 is a schematic view showing a gas appliance of a first embodiment according to the present invention.

The following illustrative embodiments and drawings are provided to illustrate the disclosure of the present invention, these and other advantages and effects can be clearly understood by persons skilled in the art after reading the disclosure of this specification. As shown in FIG. 3, a gas appliance 2 of a first embodiment according to the present invention includes a burner 20, a gas valve 22, an ignitor 24, a thermocouple 26, and a control device 28. In this embodiment, the gas appliance 2 is a gas stove as an example. However, this is not a limitation of the present invention. The gas appliance 2 could also be a gas heating device such as a fireplace or a water heater for example.

The burner 20 includes at least one flame port which is adapted to burn gas to generate flames. The gas valve 22 is disposed on a gas pipe P communicating with the burner 20. The gas valve 22 is controllable to open or block the gas pipe P and regulate a gas flow supplying to the burner 20. The ignitor 24 is disposed adjacent to the flame port of the burner 20, and is controllable to generate sparks with respect to the burner 20 so as to ignite the gas output from the flame port of the burner 20. The thermocouple 26 is disposed adjacent to the burner 20, and is adapted to sense the flames and output a corresponding sensing voltage.

Figure 4:
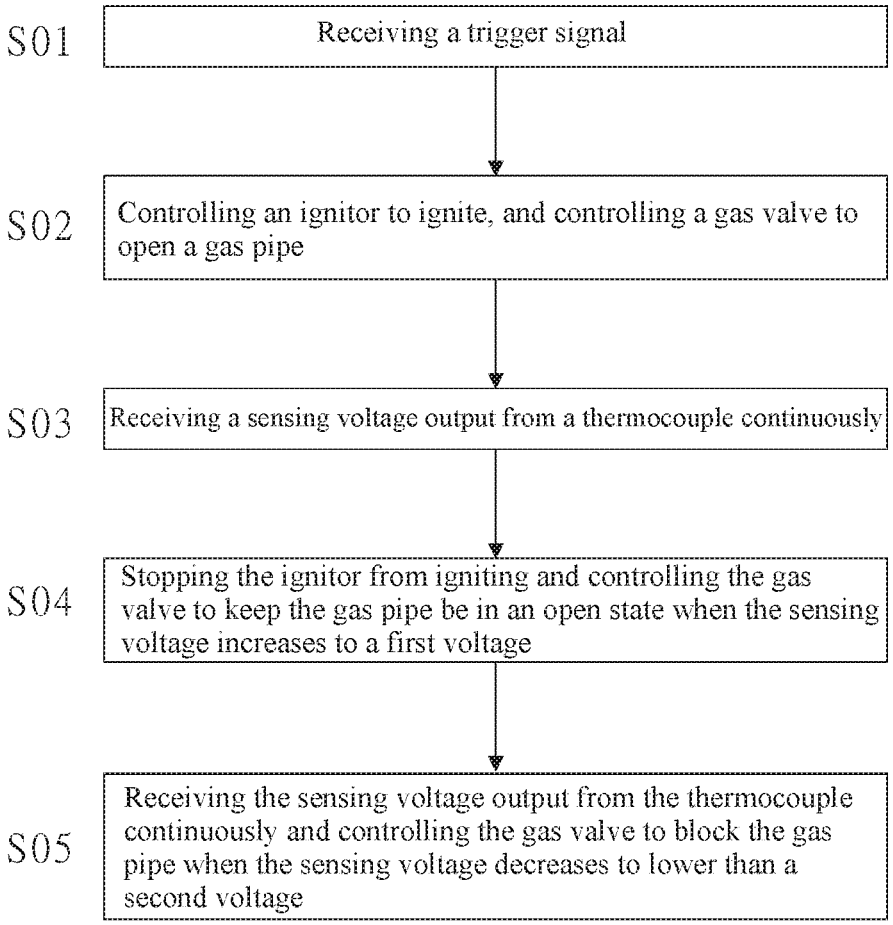
FIG. 4 is a flowchart of a control method for the gas appliance of FIG. 3.

The control device 28 is electronically connected to the gas valve 22, the ignitor 24, and the thermocouple 26. In addition, the control device 28 is further electronically connected to a trigger which is a switch 30 as an example. The switch 30 is triggered by a user to generate a trigger signal, and outputs the trigger signal to the control device 28. The control device 28 includes an ignition circuit (not shown) to control the ignitor 24. The control device 28 is adapted to execute a control method for the gas appliance 2 of this embodiment, wherein the control method comprises the following steps, which are shown in FIG. 4.

Step S01: receiving the trigger signal generated by the switch 30.

Step S02: controlling the ignitor 24 to ignite, and controlling the gas valve 22 to open the gas pipe P for supplying the gas to the burner 20.

Step S03: receiving the sensing voltage output from the thermocouple 26 continuously.

Figure 5:
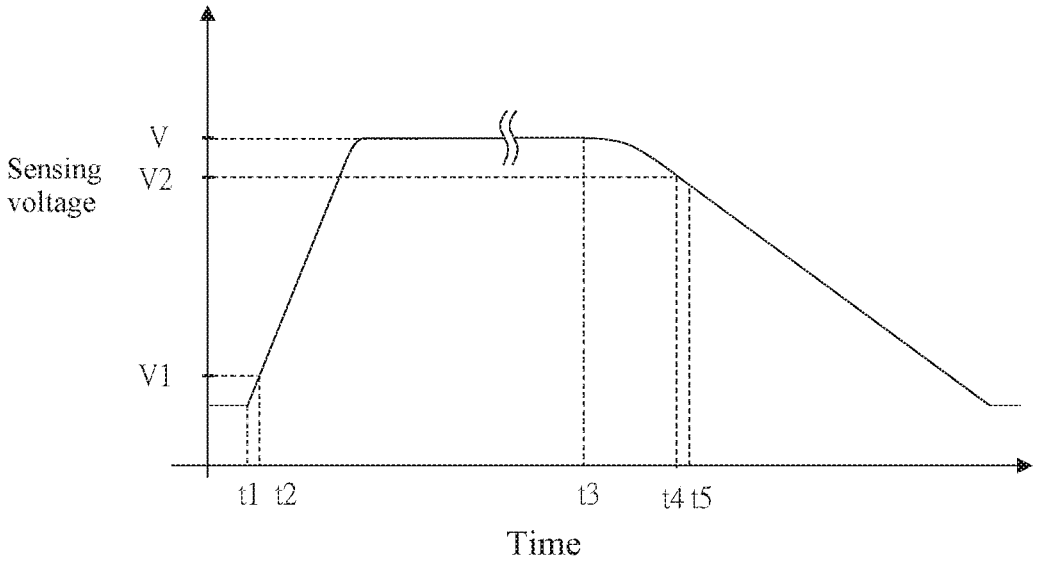
FIG. 5 is a timing diagram showing a relationship between the sensing voltage output from the thermocouple and time according to the first embodiment.

Referring to FIG. 5, the sensing voltage would gradually increase when the gas output from the flame port of the burner 20 is ignited (i.e., at the time t1).

Step S04: when the sensing voltage increases to a first voltage V1 (i.e., at the time t2), the control device 28 would identify that the ignition is successful, and meanwhile, the control device 28 would stop the ignitor 24 from igniting and control the gas valve 22 to keep the gas pipe P be in an open state to supply gas to the burner 20 continuously. The thermocouple 26 is continuously heated by the flames to make the sensing voltage increase from the first voltage V1 to a predetermined voltage V, wherein the predetermined voltage V is determined by a flame size (that is, the predetermined voltage V is varied depending on the gas flow rate output to the burner 20). In order to illustrate easily, in FIG. 5, for example, a maximum gas flow rate is controlled to be output from the gas valve 22, and the predetermined voltage V is defined as a maximum sensing voltage which could be output from the thermocouple 26 when the gas appliance 2 is supplied with the maximum gas flow rate.

Step S05: then, the control device 28 continuously receives the sensing voltage output from the thermocouple 26. When the flames are extinguished (i.e., at the time t3), but not because the gas is blocked by the gas valve 22, for example, the flames are extinguished by wind or due to insufficient gas flow rate, the sensing voltage output from the thermocouple 26 would decrease gradually from the predetermined voltage V which is higher than a second voltage V2 to the sensing voltage which is lower the second voltage V2 (i.e., at the time t4), and meanwhile, the control device 28 would identify that the flames are extinguished and control the gas valve 22 to block the gas pipe P. Wherein, the second voltage V2 is higher than the first voltage V1. In this embodiment, the second voltage V2 is higher than twice of the first voltage V1.

With the aforementioned steps, as comparing to the conventional gas appliance 1, the gas appliance 2 of the present invention could identify the successful ignition faster so as to reduce a time for the ignitor 24 to continuously ignite. In addition, the gas appliance 2 could block the gas earlier when the flames are extinguished abnormally, thereby preventing the gas from leaking out of the flame port of the burner 20 for a long time.

Sometimes the flames are blew by wind and lose contact with the thermocouple 26 temporarily but soon contact with the thermocouple 26 again, which makes the sensing voltage output from the thermocouple 26 become lower than the second voltage V2 in a short time but then become higher than the second voltage V2 again. Hence, the control device 28 would identify that the flames are extinguished and control the gas valve 22 to block the gas pipe P. In order to prevent the aforementioned situation, in a second embodiment, it could further include a step of controlling the gas valve 22 to block the gas pipe P until the sensing voltage is continuously lower than the second voltage V2 for a predetermined period of time such that the gas would not be blocked as the flames lose contact with the thermocouple 26 temporarily. Preferably, the predetermined period of time is within ten seconds, that is, the gas valve 22 is controllable to block the gas pipe P within ten seconds after the time t4 (i.e., at the time t5), as shown in FIG. 5.

After step S04, a control method for the gas appliance 2 of a third embodiment further includes the following steps. The control device 28 is adapted to identify the gas flow rate, which is regulated by the gas valve 22, supplying to the burner 20 (e.g., the gas flow rate is identified according to an opening degree of the gas valve 22 or is identified by utilizing an anemometer). When the gas flow rate supplying to the burner 20 reaches a predetermined gas flow rate for a predetermined period of time (e.g., two to five minutes in this embodiment), or when a slope of the sensing voltage with respect to time decreases to a predetermined slope (that is, a temperature of the flames is stable), a voltage of the sensing voltage would be recorded and a new first voltage V1 for next ignition would be set based on the recorded voltage. The aforementioned predetermined slope is larger than or equal to zero. In this embodiment, the recorded voltage is at least divided by two to be set as the new first voltage V1. Preferably, the new first voltage V1 could be set as one value which is between one third and one fourth of the recorded voltage. Preferably, the predetermined gas flow rate is the maximum gas flow rate output from the gas valve 22. Hence, the recorded voltage would be equal to the predetermined voltage V which is shown in FIG. 5. Whereby, an error of the sensing voltage caused by an aging, oxidized, or contaminated thermocouple 26 could be adjusted.

Moreover, the second voltage V2 in step S05 could be set based on the recorded voltage as well. In this embodiment, the second voltage V2 is higher than half of the recorded voltage. Preferably, the second voltage V2 could be set as one value which is between two third and three fourth of the recorded voltage.

In practice, the recorded voltage could be the maximum voltage output from the thermocouple 26 in a predetermined temperature, and the predetermined gas flow rate is the gas flow rate which could enable the flames generated by the burner to reach the predetermined temperature.

Moreover, the control method of each of the aforementioned embodiments could be applied to a premixed gas appliance which includes a blower such that air and gas could be premixed and then be supplied to the burner.

According to the illustration mentioned above, through defining the sensing voltage output from the thermocouple 26 as the first voltage V1 for identifying the successful ignition, the ignition procedure with the ignitor 24 could be speeded up, and the ignition time and the power consumption during the ignition could be reduced. The gas could further be blocked earlier as the second voltage V2, which is higher than the first voltage V1, is utilized for identifying the extinguished flames, thereby improving the security of the gas appliance 2.

It must be pointed out that the embodiments described above are only some embodiments of the present invention. All equivalent structures which employ the concepts disclosed in this specification and the appended claims should fall within the scope of the present invention.

What is claimed is:

1. A control method for a gas appliance, wherein the gas appliance includes a burner, a gas valve, an ignitor, and a thermocouple, wherein the burner includes at least one flame port; the gas valve is disposed on a gas pipe communicating with the burner, and is controllable to open or block the gas pipe; the ignitor is disposed adjacent to the at least one flame port of the burner, and is controllable to ignite gas output from the at least one flame port; the thermocouple is disposed adjacent to the burner, and is adapted to sense flames and output a corresponding sensing voltage; the control method comprises steps of:

A. controlling the ignitor to ignite, and controlling the gas valve to open the gas pipe;

B. receiving the sensing voltage output from the thermocouple;

C. stopping the ignitor from igniting and controlling the gas valve to keep the gas pipe in an open state based on the sensing voltage output reaching to a first threshold voltage; and D. receiving the sensing voltage output from the thermocouple continuously, and controlling the gas valve to block the gas pipe in response to the sensing voltage output changing from being decreases from higher than a second threshold voltage to being lower than the second threshold voltage, wherein the second threshold voltage is higher than the first threshold voltage, and controlling the gas valve to block the gas pipe based on the sensing voltage output being is lower than the second threshold voltage for a predetermined period of time.

2. The control method for the gas appliance of claim 1, wherein the predetermined period of time is within ten seconds.

3. The control method for the gas appliance of claim 1, wherein the method further comprises the following steps after step C: recording a voltage of the sensing voltage and setting a new first voltage based on the recorded voltage, the recording being based on a slope of the sensing voltage with respect to time decreasing to a predetermined slope, or the gas flow rate supplied to the burner reaching reaches a predetermined gas flow rate for a predetermined period of time, and wherein the predetermined slope is larger than or equal to zero.

4. The control method for the gas appliance of claim 3, wherein the recorded voltage is at least divided by two to be set as the new first voltage after step C.

5. The control method for the gas appliance of claim 4, wherein the new first voltage V1 is between one third and one fourth of the recorded voltage.

6. The control method for the gas appliance of claim 1, wherein the method further comprises the following steps between steps C and D:

recording a voltage of the sensing voltage based on a slope of the sensing voltage with respect to time decreasing to a predetermined slope, or the gas flow rate supplied to the burner reaching a predetermined gas flow rate for a predetermined period of time; in step D, the second voltage is set based on the recorded voltage, wherein the predetermined slope is larger than or equal to zero.

7. The control method for the gas appliance of claim 6, wherein the second voltage is higher than half of the recorded voltage.

8. The control method for the gas appliance of claim 7, wherein the second voltage is between two third and three fourth of the recorded voltage.

9. The control method for the gas appliance of claim 1, wherein the second voltage is higher than twice of the first voltage.

10. A gas appliance, comprising:

a burner, including at least one flame port;

a gas valve, disposed on a gas pipe communicating with the burner, wherein the gas valve is controllable to open or block the gas pipe;

an ignitor, disposed adjacent to the at least one flame port of the burner, wherein the ignitor is controllable to ignite gas output from the at least one flame port;

a thermocouple, disposed adjacent to the burner, and adapted to sense flames and output a corresponding sensing voltage; and a control device, being electronically connected to the gas valve, the ignitor, and the thermocouple, wherein the control device is adapted to control the ignitor to ignite and control the gas valve to open the gas pipe, and to stop the ignitor from igniting and control the gas valve to keep the gas pipe in an open state based on the sensing voltage output from the thermocouple reaching to a first threshold voltage; then, the control device is adapted to control the gas valve to block the gas pipe in response to when the sensing voltage output from the thermocouple changing from being higher than a second threshold voltage to being lower than the second threshold voltage, wherein the second threshold voltage is higher than the first threshold voltage; and wherein the control device is adapted to control the gas valve to block the gas pipe based on the sensing voltage output from the thermocouple being lower than the second threshold voltage for a period of time.

11. The gas appliance of claim 10, wherein the second threshold voltage is higher than twice of the first threshold voltage.

* * * * *